US007449828B2

(12) United States Patent
Ando et al.

(10) Patent No.: US 7,449,828 B2
(45) **Date of Patent: *Nov. 11, 2008**

(54) IMAGE FORMING APPARATUS PROVIDED WITH RESISTIVE-COATED SPACERS CONTACTING PROTRUDING SECTIONS OF WIRING ELEMENTS

(75) Inventors: Yoichi Ando, Tokyo (JP); Osamu Takamatsu, Kanagawa (JP); Taro Hiroike, Kanagawa (JP); Akira Hayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/470,876

(22) Filed: Sep. 7, 2006

(65) Prior Publication Data

US 2007/0018560 A1 Jan. 25, 2007

Related U.S. Application Data

(62) Division of application No. 10/833,124, filed on Apr. 28, 2004, now Pat. No. 7,138,758.

(30) Foreign Application Priority Data

May 15, 2003 (JP) ..... 2003-136741

(51) Int. Cl.
*H01J 1/62* (2006.01)
*H01J 63/04* (2006.01)

(52) U.S. Cl. ..... 313/495; 313/497; 313/292

(58) Field of Classification Search ..... 313/495–497, 313/292

See application file for complete search history.

(56) References Cited

U.S. PATENT DOCUMENTS

| | | | | |
|---|---|---|---|---|
| 5,760,538 | A | 6/1998 | Mitsutake et al. | |
| 6,053,791 | A | 4/2000 | Fujii et al. | |
| 6,184,619 | B1 | 2/2001 | Yamazaki et al. | |
| 6,254,449 | B1 | 7/2001 | Nakanishi et al. | |
| 6,274,972 | B1 | 8/2001 | Mitsutake et al. | |
| 6,441,544 | B1 | 8/2002 | Ando et al. | |
| 6,506,089 | B2 | 1/2003 | Nakanishi et al. | |
| 6,534,911 | B1 | 3/2003 | Ando | |
| 6,802,753 | B1 | 10/2004 | Ando et al. | 445/6 |

(Continued)

FOREIGN PATENT DOCUMENTS

EP 1 258 907 A2 11/2002

(Continued)

*Primary Examiner*—Mariceli Santiago
(74) *Attorney, Agent, or Firm*—Fitzpatrick, Cella, Harper & Scinto

(57) ABSTRACT

In order to prevent a spacer from being charged by using a plate shaped spacer covered with a high resistance film, the present invention is aimed at preventing irregular displacements of electron beams emitted from adjacent electron-emitting devices and suppressing displacements of impinging positions of the electron beams emitted from the adjacent electron-emitting devices even with a slight displacement of an installation position of the spacer. The spacer is disposed along a row directional wiring. The high resistance film is allowed to come into contact with a metal back and the row directional wiring to achieve electrical connection therebetween. Contact portions between the high resistance film of the spacer and the row directional wiring are provided at predetermined intervals.

2 Claims, 13 Drawing Sheets

U.S. PATENT DOCUMENTS

| | | | | |
|---|---|---|---|---|
| 6,884,138 | B1 | 4/2005 | Ando et al. | 445/24 |
| 7,138,758 | B2 * | 11/2006 | Ando et al. | 313/495 |
| 2002/0005692 | A1 | 1/2002 | Ando | |
| 2002/0190633 | A1 | 12/2002 | Tagawa et al. | |
| 2003/0164675 | A1 | 9/2003 | Ando | |
| 2004/0080259 | A1 | 4/2004 | Ando | |
| 2004/0171470 | A1 | 9/2004 | Hayama | 445/24 |

FOREIGN PATENT DOCUMENTS

| | | |
|---|---|---|
| EP | 0 869 531 B1 | 2/2004 |
| JP | 8-180821 | 7/1996 |
| JP | 10-106457 | 4/1998 |
| JP | 10-334832 | 12/1998 |
| JP | 10-334834 | 12/1998 |
| JP | 2003-29697 | 1/2003 |
| KR | 10-0220216 | 6/1999 |

* cited by examiner

IMAGE FORMING APPARATUS PROVIDED WITH RESISTIVE-COATED SPACERS CONTACTING PROTRUDING SECTIONS OF WIRING ELEMENTS

This application is a division of U.S. application Ser. No. 10/833,124, filed Apr. 28, 2004, now U.S. Pat. No. 7,138,758, issued Nov. 21, 2006.

BACKGROUND OF THE INVENTION

1. Field of the Invention

The present invention relates to an image forming apparatus used for, for example, a display panel. In particular, the present invention relates to an image forming apparatus, which includes a spacer between a first substrate having a plurality of electron-emitting devices and a second substrate opposingly disposed to the first substrate.

2. Related Background Art

In general, in an image forming apparatus having a first substrate on an electron source side and a second substrate on a display surface side, which are opposingly disposed to each other with a distance, a spacer made of an insulating material is sandwiched between the first substrate and the second substrate to obtain a necessary atmospheric pressure resistance. However, the spacer is charged to affect an electron trajectory near the spacer. Therefore, there is a problem in that a displacement of a light-emitting position is caused. This causes image deterioration such as a reduction in light-emitting intensity or color blurring at a pixel near the spacer.

As known in the art so far, in order to prevent the above-mentioned spacer from being charged, a spacer covered with a high resistance film is used.

More specifically, there has been known an image forming apparatus in which a plate shaped spacer covered with the high resistance film is disposed along a wiring on the first substrate and the high resistance film is directly connected with the wiring and an electrode on the second substrate by an electroconductive adhesive. In addition, there has been known an image forming apparatus in which spacer electrodes are provided above and below a spacer covered with the high resistance film and the spacer is sandwiched such that the high resistance film is in contact with the wiring and the electrode through the spacer electrodes (see U.S. Pat. No. 5760538, JP08-180821 A).

Also, it has been proposed that an electroconductive intermediate layer (spacer electrode) is provided on each of the first substrate side and the second substrate side of the spacer covered with the high resistance film to function as an electrode for controlling an electron beam trajectory (see U.S. Pat. No. 6184619, JP10-334834 A).

In the image forming apparatus in which the spacer electrodes are provided above and below the spacer covered with the high resistance film and the high resistance film is connected with the wiring on the first substrate and the electrode on the second substrate through the spacer electrodes, as described in JP 08-180821 A, an electric field is distributed near spacer electrode portions. The electric field is distributed substantially uniform in the longitudinal direction of the spacer but generated with high intensity as compared with the case where the spacer is not disposed. Therefore, in the case where the spacer is disposed, when misalignment is caused, impinging positions of electron beams emitted from adjacent electron-emitting devices are likely to extensively change. In addition, it has been found that the spacer electrodes cause discharging and thus a quality of an image is likely to significantly deteriorate. To cope with the deterioration, it is necessary to provide the spacer electrodes so as not to expose to the side surface of the spacer or to dispose the spacer with high precision. In any manner, an increase in cost is caused.

In the image forming apparatus described in JP 10-334834 A, the intermediate layer (spacer electrode) is exposed to the side surface of the spacer. Therefore, as in the case where the spacer electrodes in JP 08-180821 A are exposed to the side surface of the spacer, unless high alignment precision of the spacer is maintained, desired control cannot be performed. Thus, there is a problem in that an increase in cost is unavoidable. In addition, for example, when a pixel pitch is reduced, an emitting position of an electron beam approaches the spacer. As a result, it is necessary to design a new spacer electrode having a corresponding shape, which causes an increased cost.

SUMMARY OF THE INVENTION

An object of the present invention is to prevent irregular displacements of electron beams emitted from adjacent electron-emitting devices and to suppress displacements of impinging positions of the electron beams emitted from the adjacent electron-emitting devices even with a slight displacement of an installation position of a spacer, in order to prevent the spacer from being charged by using a plate shaped spacer covered with a high resistance film. In addition, another object of the present invention is to allow applications of the spacer having the same structure to various modes of apparatuses.

In order attain the above-mentioned object, the present invention provides an image forming apparatus including: a first substrate having a plurality of electron-emitting devices and a wiring for driving the electron-emitting devices; a second substrate opposingly disposed to the first substrate, and having an electroconductive member set at a potential higher than that of the wiring; and a plate shaped spacer disposed along the wiring between the first and second substrates, the spacer being covered with a film of a resistance higher than that of the wiring, the film being connected electrically with the electroconductive member and the wiring, in which electrical contact portions between the film and the wiring are arranged at a predetermined interval along the wiring. Note that, here, the plate shape preferably represents a plate shape having a length enough to make discrete contact between the spacer and the wiring. The enough length means a length, which is equal to or longer than an interval (device pitch) between electron-emitting devices adjacent to each other. An example of the plate shaped spacer includes a rectangular spacer with the length longer than a pitch between devices.

The present invention is aimed at positively controlling a contact position and a non-contact position between the high resistance film of the spacer and the wiring on the first substrate. Therefore, an irregular potential distribution on the surface of the spacer is prevented from occurring, thereby making it possible to easily control the impinging positions of the electron beams emitted from the adjacent electron-emitting devices.

Hereinafter, an operation of the present invention will be described relative to the case where the structure according to the present invention is not used, that is, the case where the contact position and the non-contact position between the high resistance film of the spacer and the wiring on the first substrate are not controlled.

As regards the image forming apparatus in which the high resistance film is directly brought into pressure contact with the wiring on the first substrate and the electrode on the second substrate, the inventors of the present invention have newly found that charging of the spacer is not sufficiently prevented and the potential distribution on the surface of the spacer becomes unintended distribution in some cases.

A factor of the above-mentioned phenomenon is dependent on a manufacturing process of a display device in many cases. Although that depends, it has been found that the phenomenon is caused in the case where a continuous contact between the high resistance film of the spacer and the wiring or the electrode is not made to cause a partial non-contact portion, thereby making it impossible to attain sufficient electrical connection. More specifically, there are the case where an unexpected distortion or the like is caused in the wiring on the first substrate and the electrode on the second substrate, the case where foreign matters exist on the wiring and the electrode, and the case where an unintended burr is caused in the wiring and the electrode. In particular, a surface shape of a wiring formed by a manufacturing method at low cost is partially changed in some cases. Therefore, the above-mentioned electrical connection failure is likely to occur.

In the above-mentioned case, a defect is caused in which not only a problem as to the charging of the spacer is not adequately solved but also the potential distribution on the surface of the spacer irregularly changes not to obtain an electron beam trajectory as designed. In addition, the electron beam is accelerated from the first substrate to the second substrate. Therefore, with respect to its trajectory change, the influence of a deflection force on the first substrate side is greater than that on the second substrate side.

The deflection of the electron beam which is caused by the potential distribution on the surface of the spacer on the first substrate side will be more specifically described with reference to FIGS. 21A and 21B.

FIG. 21A shows the potential distribution on the surface of the spacer when unintended partial contact is made between the high resistance film and the wiring in the case where the plate shaped spacer which is covered with the high resistance film is disposed along the wiring on the first substrate. FIG. 21B shows an equivalent circuit of FIG. 21A.

As shown in FIGS. 21A and 21B, when a resistance between a point C and a point A is given as $R_1$, a resistance between a point B which is a non-contact portion and a corresponding point D equals $R_1$. Therefore, a potential at the point B becomes higher than a potential at the point A by a voltage drop due to $R_2$ (resistance between the point A which is a contact portion and the point B). Thus, the trajectory of the electron beam emitted from the electron-emitting device near the point B is different in behavior from the trajectory of the electron beam emitted from the electron-emitting device near the point A. As a result, an image at the point C is different from an image at the point D (image is distorted).

In contrast to this, the present invention is aimed at positively controlling the contact position and the non-contact position between the high resistance film of the spacer and the wiring on the first substrate. Therefore, an irregular potential distribution on the surface of the spacer is prevented from occurring, thereby making it possible to easily control the impinging positions of the electron beams emitted from the adjacent electron-emitting devices.

Note that, in the present invention, to positively control the contact position and the non-contact position between the high resistance film of the spacer and the wiring on the first substrate is more specifically to control a shape of the contact portion between the spacer and the wiring to thereby control the contact position and the non-contact position. Therefore, the potential distribution on the surface of the spacer is positively controlled to obtain an electric field, which is easy to determine a desirable impinging position of the electron beam.

As a specific mode for controlling the shape of the contact portion between the spacer and the wiring, there are a method of forming concave and convex portions on the wiring side surface of the spacer and a method of forming the concave and convex portions on the wiring. The method of forming the concave and convex portions on the wiring includes a method of providing a pad member (base) below the wiring to partially protrude the wiring thereby and a method of forming an electroconductive convex portion on the wiring. When those methods are used, the concave and convex portions having a height equal to or larger than irregularities in shape (surface roughness, partial protrusion, or the like) depending on a manufacturing method can be positively formed to positively control the position of the contact portion and the position of the non-contact portion. That is, the present invention is based on a change in thinking. The entire contact between the spacer and the wiring is not made but positive control is performed to make partial contact to thereby form a controlled equipotential surface on the surface of the spacer.

According to a preferable mode of the controlled equipotential surface, the equipotential surface has periodicity corresponding to the electron-emitting devices. In order to realize this, there is an example in which the periodicity is allowed for a pitch of contact portions between the high resistance film of the spacer and the wiring. It is preferable that the pitch between the contact portions has the periodicity constant times a pitch between the electron-emitting devices. Note that each pitch between the contact portions does not necessarily have the periodicity corresponding to the pitch between the electron-emitting devices. For example, when the electron-emitting devices composing a pixel, which are formed from phosphors of R, G, and B are assumed as one unit, it is possible that the pitch between the contact portions has the periodicity that a pitch between the units is set as one period. In addition, each interval between the contact portions does not necessarily have the periodicity. As described above, it is important to control the equipotential surface near the spacer. If the periodicity of the equipotential surface is obtained, the mode is substantially preferable. As an example of such a mode, there is a mode in which the periodicity is allowed between a single portion having a large contact area and a group in which a plurality of portions each having a small contact area are formed adjacent to one another. Even in this case, the periodicity of the equipotential surface is obtained, so that such a mode is preferable.

DETAILED DESCRIPTION OF THE PREFERRED EMBODIMENTS

Hereinafter, the present invention will be specifically described with reference to the drawings.

First Embodiment

Figure 1:
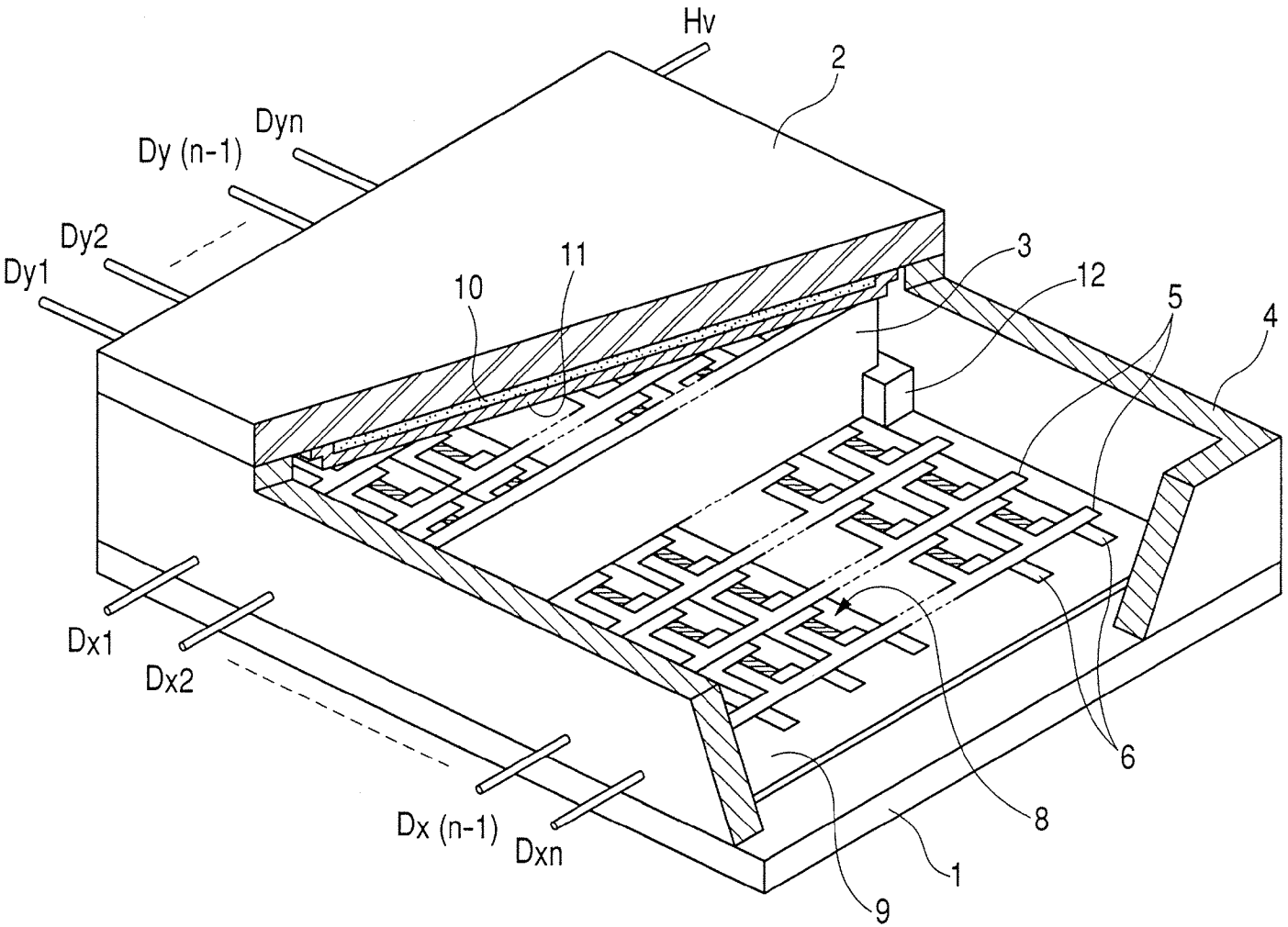
FIG. 1 is a cutaway perspective view showing a display panel serving as an image forming apparatus according to a first embodiment of the present invention.
Figure 2:
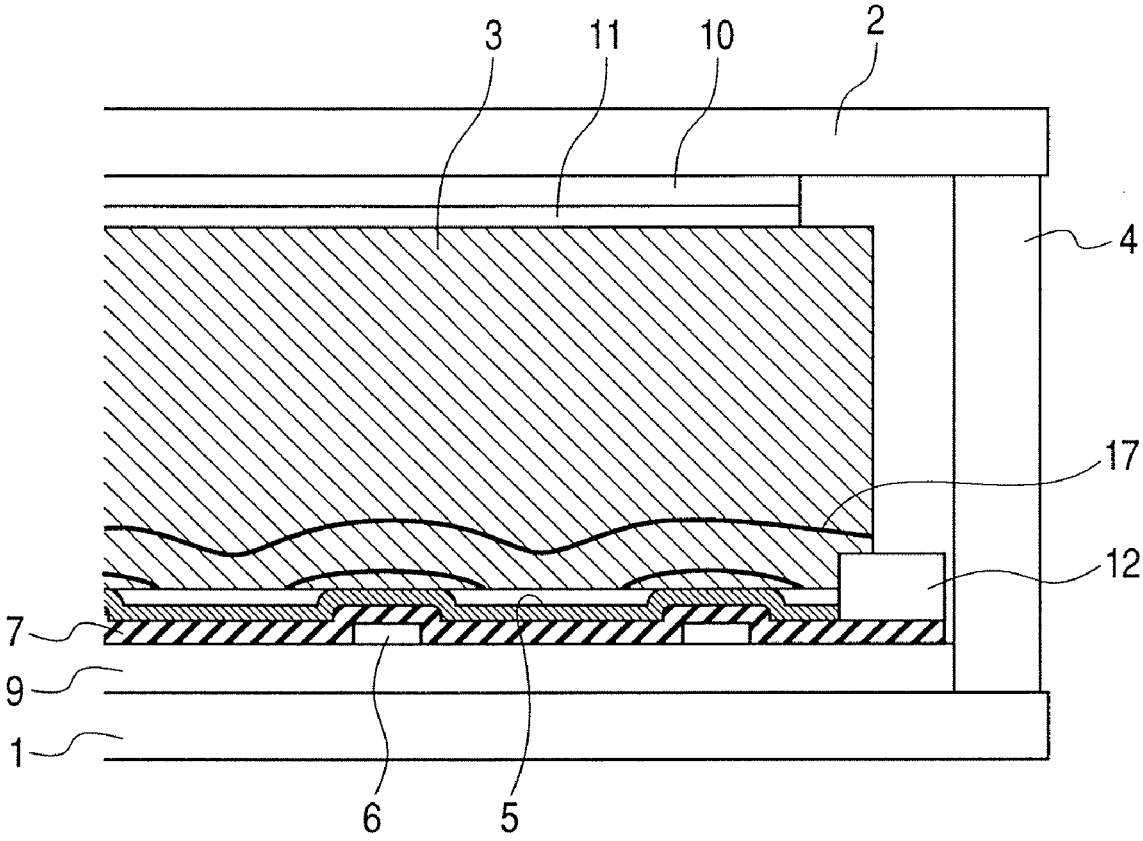
FIG. 2 is a partial sectional view showing the display panel in a longitudinal direction of a spacer according to the first embodiment of the present invention.
Figure 3:
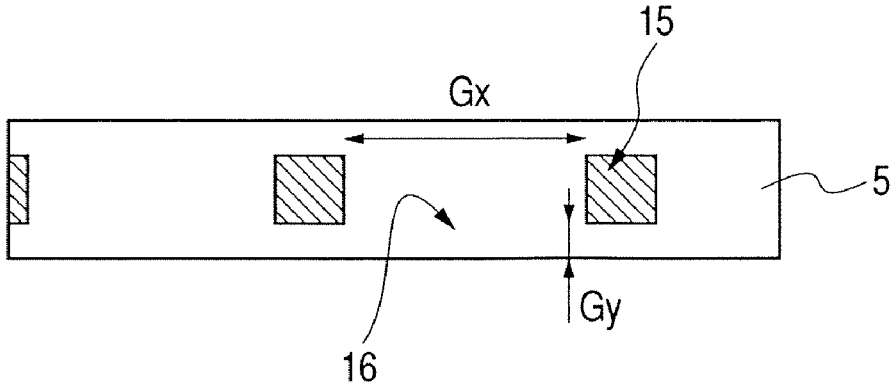
FIG. 3 is an explanatory view showing a contact portion and a non-contact portion between a high resistance film of the spacer and a row directional wiring according to the first embodiment of the present invention.
Figure 4:
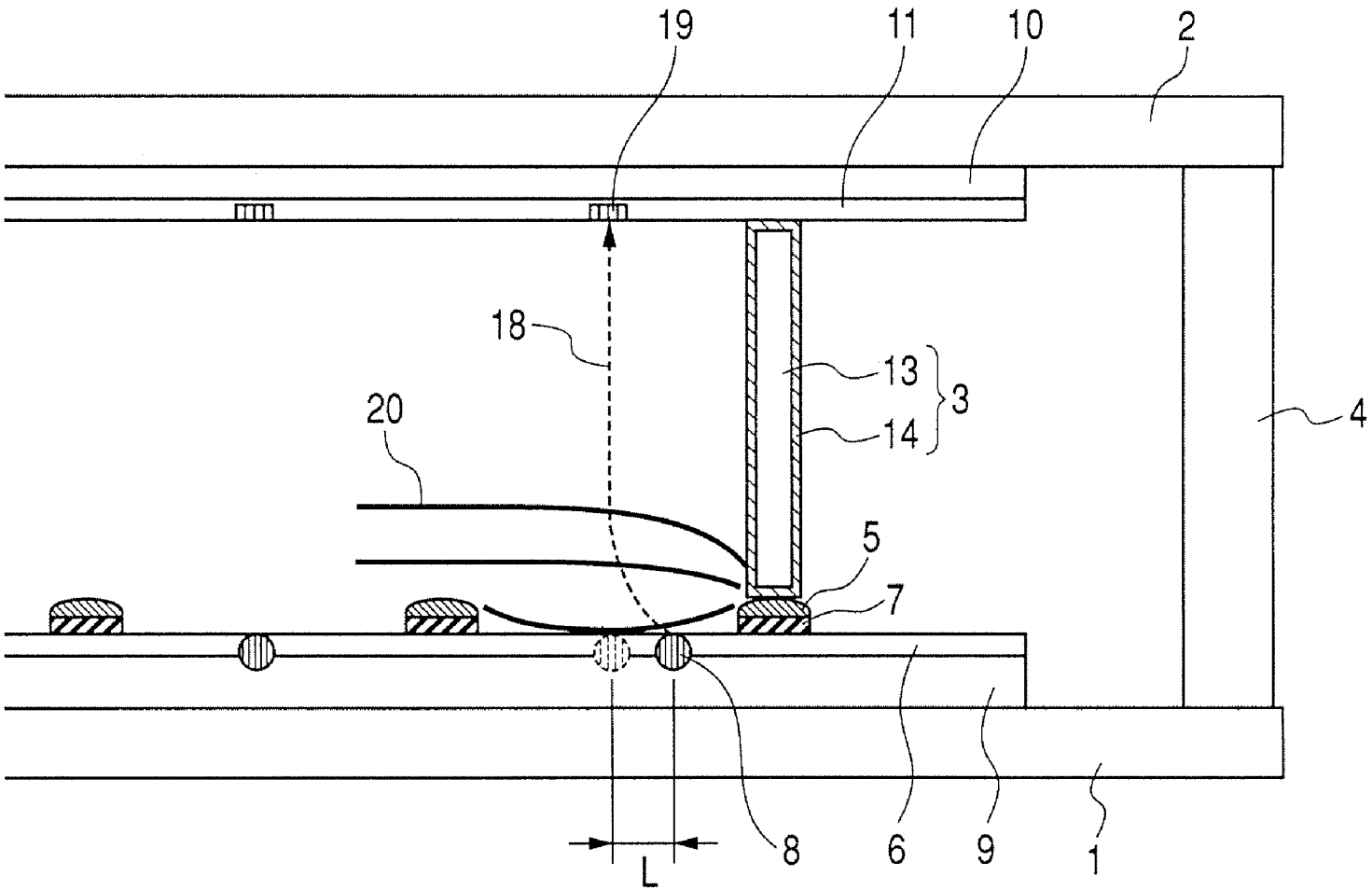
FIG. 4 is a partial sectional view showing the display panel in a direction orthogonal to the spacer according to the first embodiment of the present invention.
Figure 5:
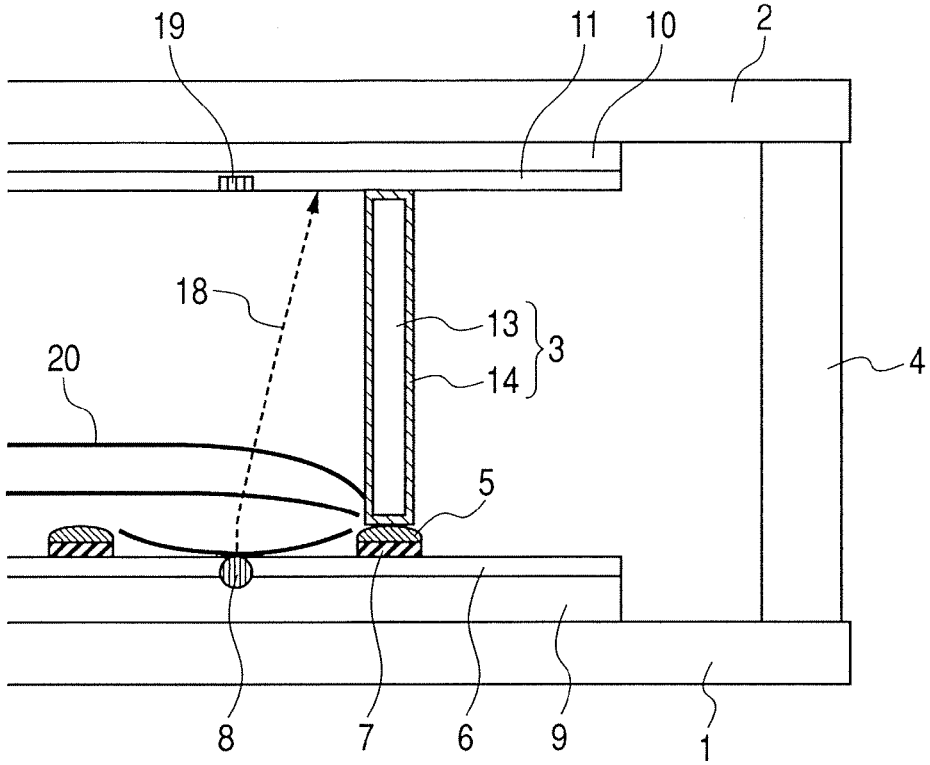
FIG. 5 is an explanatory view showing a trajectory of an electron beam according to the first embodiment of the present invention.
Figure 6:
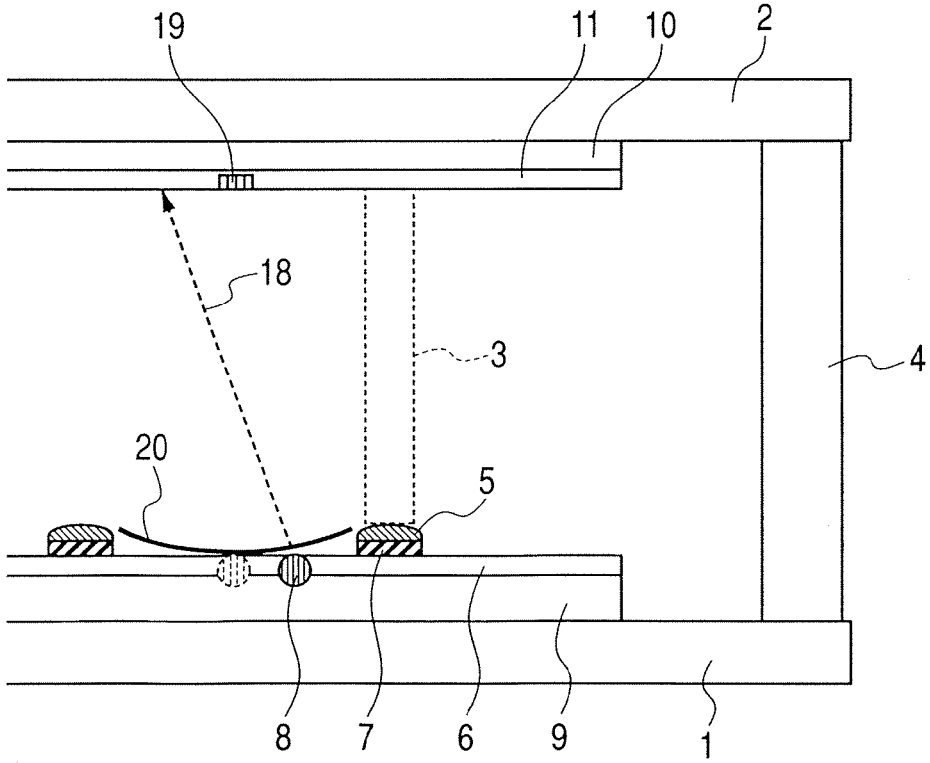
FIG. 6 is an explanatory view showing a trajectory of an electron beam according to the first embodiment of the present invention.
Figure 7:
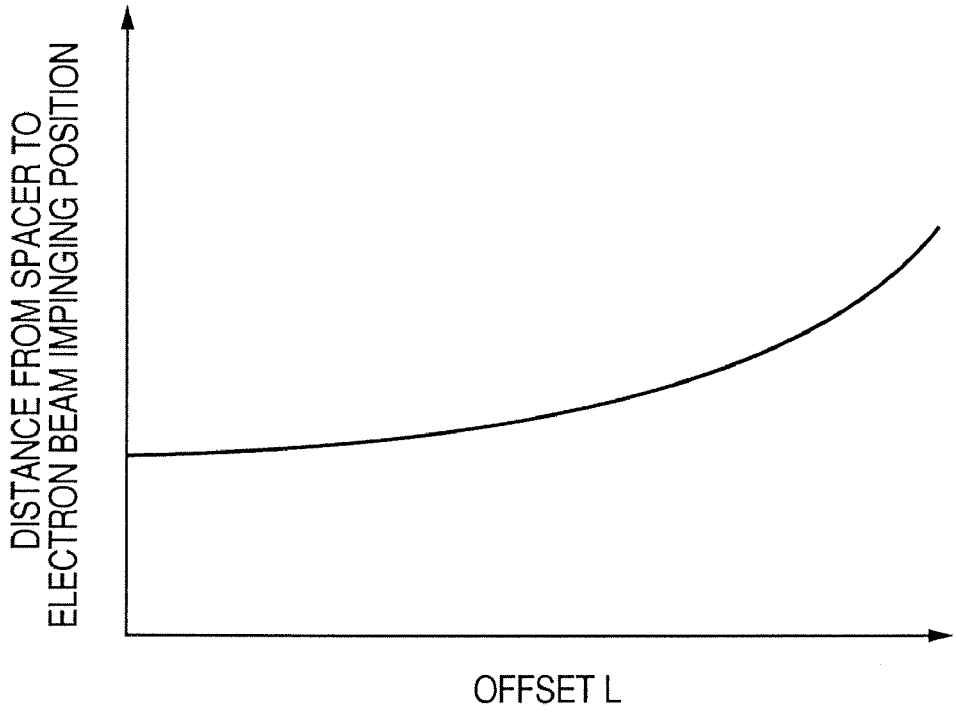
FIG. 7 is a graph showing a relationship between a distance from the spacer to an electron beam impinging position and an offset.
Figure 8:
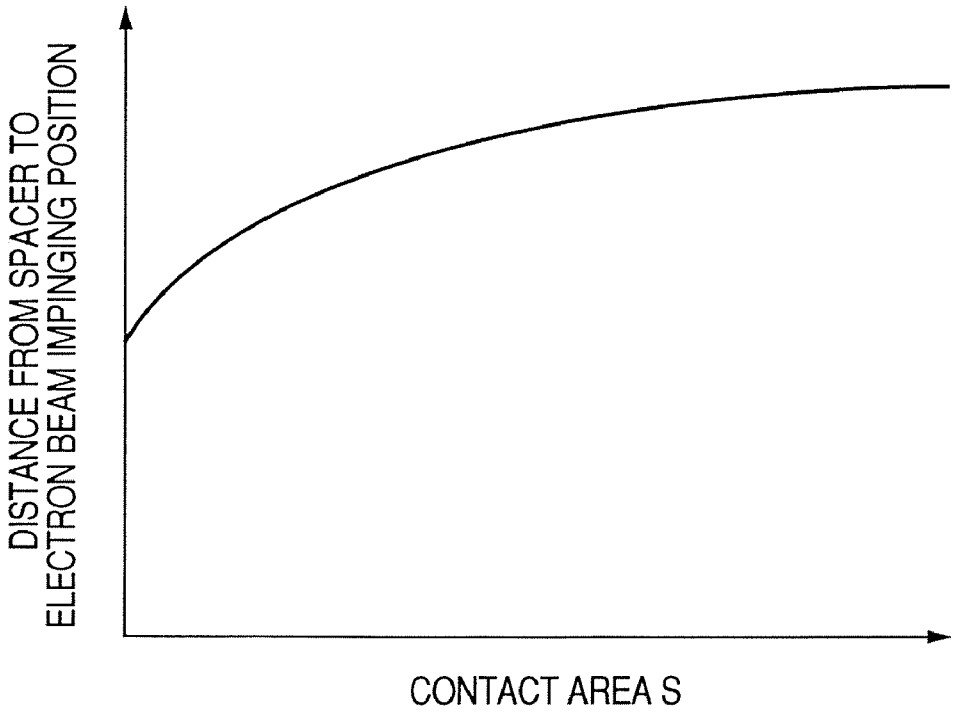
FIG. 8 is a graph showing a relationship between a distance from the spacer to the electron beam impinging position and a contact area.
Figure 9:
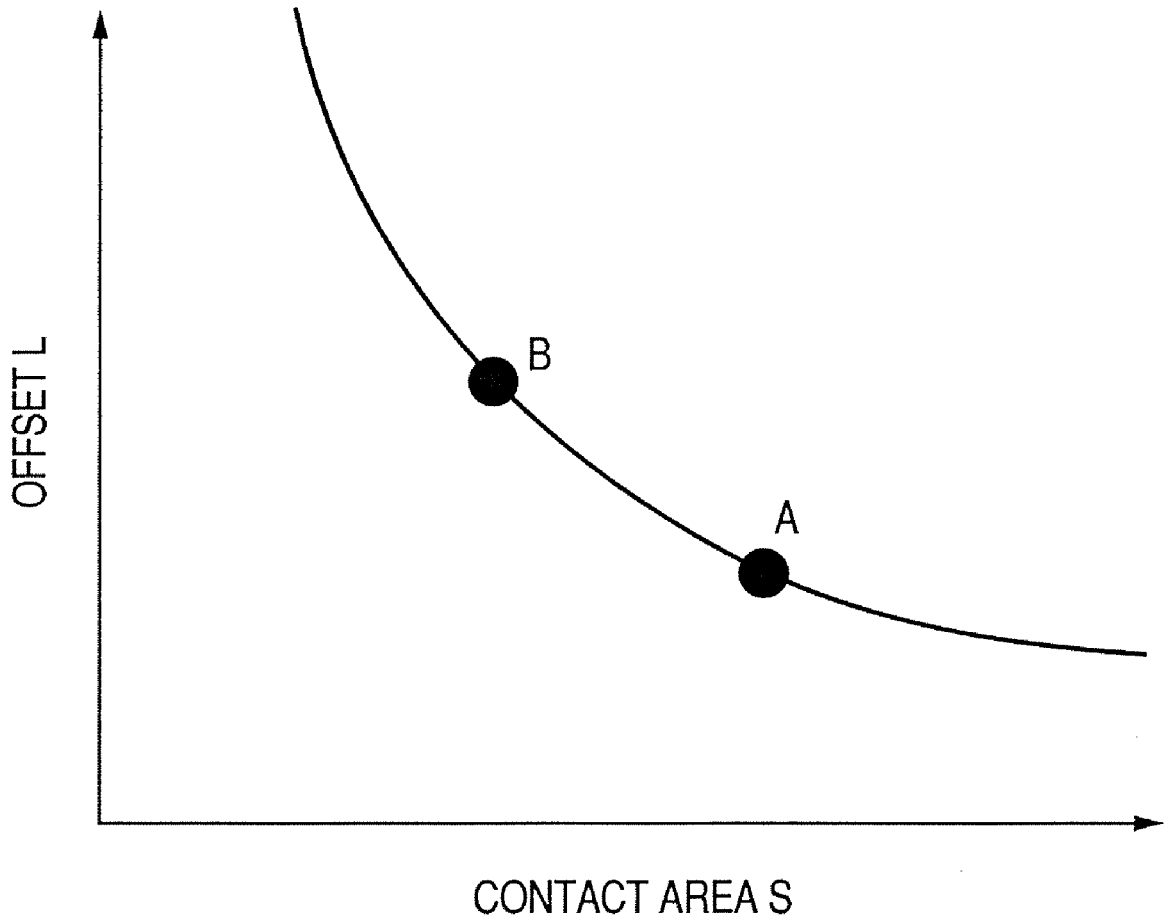
FIG. 9 is a graph showing a relationship between the offset and the contact area.

FIG. 1 is a cutaway perspective view showing a display panel serving as an image forming apparatus according to a first embodiment of the present invention. FIG. 2 is a partial sectional view showing the display panel in a longitudinal direction of a spacer. FIG. 3 is an explanatory view showing a contact portion and a non-contact portion between a high resistance film of the spacer and a row directional wiring. FIG. 4 is a partial sectional view showing the display panel in a direction orthogonal to the spacer. FIGS. 5 and 6 each are an explanatory view showing a trajectory of an electron beam. FIG. 7 is a graph showing a relationship between a distance from the spacer to an electron beam impinging position and an offset of a device to the spacer. FIG. 8 is a graph showing a relationship between a distance from the spacer to the electron beam impinging position and a contact area between the spacer and the wiring. FIG. 9 is a graph showing a relationship between the offset of the device to the spacer and the contact area between the spacer and the wiring.

As shown in FIG. 1, in the display panel according to this embodiment, a rear plate 1 serving as a first substrate and a face plate 2 serving as a second substrate are opposingly disposed to each other at a distance and a plate shaped spacer 3 is sandwiched therebetween. Sealing using a side wall 4 is performed on the circumference of the panel and its inner portion is in a vacuum atmosphere.

An electron source substrate 9 in which row directional wirings 5, column directional wirings 6, an interelectrode insulating layer 7 (see FIGS. 2 and 4), and electron-emitting devices 8 are formed is fixed onto the rear plate 1.

Each of the shown electron-emitting devices 8 is a surface conduction electron-emitting device in which an electroconductive thin film having an election-emitting region is connected between a pair of device electrodes. In this embodiment, the display panel includes a multi-electron beam source in which the N×M surface conduction electron-emitting devices are disposed and the M row directional wirings 5 and the N column directional wirings 6 which are formed at the same intervals are arranged in matrix. In addition, in this embodiment, the row directional wirings 5 are located on the column directional wirings 6 through the interelectrode insulating layer 7. Scanning signals are applied to the row directional wirings 5 through lead terminals Dx1 to Dxm. Modulating signals (image signal) are applied to the column directional wirings 6 through lead terminals Dy1 to Dyn.

Various electroconductive materials can be applied to the row directional wirings 5 and the column directional wirings 6. As an example, a silver paste can be used. In addition, various methods such as a screen printing method, a photolithography method, and a method of depositing a metal by plating can be applied to a method of forming the wirings.

A fluorescent film 10 is formed on a lower surface of the face plate 2 (opposite surface of the rear plate 1). Because the display panel according to this embodiment performs color display, phosphors of three primary colors of red, green, and blue are separately applied to the fluorescent film 10. The phosphors of respective colors are applied to the fluorescent film 10, for example, in a strip form. A black conductor (black strip) is provided between the strips of the phosphors of respective colors. The purposes why the black conductor is provided are to prevent a display color from varying even if the impinging position of the electron beam slightly varies, to prevent a display contrast from decreasing by suppressing the reflection of external light, and to prevent the charging up of the fluorescent film, which is caused by the electron beam. A material mainly containing graphite can be used for the black conductor. If a material is suitable for the above-mentioned purposes, another material can be used. With respect to the separate application of the phosphors of three primary colors, another arrangement such as delta arrangement can be used in addition to the above-mentioned strip form.

A metal back (accelerating electrode) 11, which is an electroconductive member provided to the face plate 2 is provided on a surface of the fluorescent film 10. The metal back 11 is used to accelerate electrons emitted from the electron-emitting devices 8 to pull them up. A high voltage is applied from a high voltage terminal Hv to the metal black 11 to specify a voltage higher than the row directional wirings 5. In the case of the display panel using the surface conduction electron-emitting devices as in this embodiment, a voltage difference of about 5 kV to 20 kV is generally produced between the row directional wirings 5 and the metal back 11.

A plate shaped spacer 3 is provided on the row directional wiring 5 in parallel to the row directional wiring 5. The spacer 3 is placed on the row directional wiring 5 and both ends thereof are bonded to a spacer fixing block 12 if necessary, thereby supporting the spacer 3. When the spacer 3 is fixed by using the spacer fixing block 12, it is possible to reduce a distortion of an electric field near the electron-emitting device 8 in which the kinetic energy of an electron is small and the electron trajectory is likely to be affected by an electric field.

In general, in order to provide the display panel with an atmospheric pressure resistance, a plurality of spacers 3 are disposed at the same intervals and sandwiched between the rear plate 1 having the electron source substrate 9 in which the electron-emitting devices 8 and the row directional wirings 5 and the column directional wirings 6 for driving the electron-emitting devices 8 are provided, and the face plate 2 in which the fluorescent film 10 and the metal back 11 are provided. Upper and lower surfaces of each of the spacers 3 are pressed to the metal back 11 and the row directional wirings 5, respectively. The side wall 4 is sandwiched between the rear plate 1 and the face plate 2 at peripheral portions. A bonding portion between the rear plate 1 and the side wall 4 and a bonding portion between the face plate 2 and the side wall 4 are sealed using frit glass or the like.

The spacer 3 will be further described. The spacer 3 has an insulating property which is resistant to a high voltage applied between the row directional wirings 5 and the column directional wirings 6 on the rear plate 1 side and the metal back 11 on the face plate 2 side. In addition, the spacer 3 has an electroconductive property capable of preventing the surface of the spacer 3 from being charged. As shown in FIG. 4, the spacer 3 is composed of a base 13 made of an insulating material and a high resistance film 14 that covers the surface of the base 13.

With respect to a construction material of the base 13 of the spacer 3, there are, for example, quartz glass, glass in which the amount of contained impurity such as Na is reduced, soda lime glass, and a ceramic such as alumina, and the like. It is preferable that a thermal expansion coefficient of the construction material of the base 13 is equal to or approximately equal to thermal expansion coefficients of construction materials of the electron source substrate 9, the rear plate 1, the face plate 2, and the like.

A current obtained by dividing an accelerating voltage Va applied to the metal back 11 serving as the high potential side by a resistance value of the high resistance film 14 is allowed to flow into the high resistance film 14 covering the surface of the spacer 3, thereby preventing the surface of the spacer 3 from being charged. Therefore, the resistance value of the high resistance film 14 is set in a desirable range from the viewpoints of preventing charging and suppressing power consumption. In view of charging prevention, a sheet resistance of the resistance film 14 is preferably $10^{14}$ Ω/square or less, more preferably $10^{12}$ Ω/square or less, and most preferably $10^{11}$ Ω/square or less. The lower limit of the sheet resistance of the resistance film 14 is varied according to the shape of the spacer 3 and a voltage applied to the spacer 3. In order to reduce the power consumption, the sheet resistance of the resistance film 14 is preferably $10^5$ Ω/square or more, more preferably $10^7$ Ω/square or more.

Although depending on surface energy of the material composing the high resistance film 14 serving as a thin film, a contact with the base 13, and a temperature of the base 13, the thin film having a thickness of 10 nm or less is generally formed in an island shape and the resistance thereof is unstable, thereby lowering the reproducibility thereof. On the other hand, when the film thickness is 1 μm or more, a film stress becomes larger, thereby increasing a fear of film peeling. In addition, a film formation time becomes longer, thereby lowering the productivity. Therefore, it is preferable that a thickness of the high resistance film 14 formed on the base 13 is within a range of 10 nm to 1 μm. More preferably, the film thickness is 50 nm to 500 nm. A sheet resistance is ρ/t (ρ: resistivity, t: film thickness) . Therefore, based on the preferable ranges of the sheet resistance and the film thickness, the resistivity ρ of the high resistance film 14 is preferably 0.1 Ωcm to $10^8$ Ωcm. In addition, in order to realize the more preferable ranges of the sheet resistance and the film thickness, the resistivity ρ is preferably $10^2$ Ωcm to $10^6$ Ωcm.

As described above, when the current flows into the high resistance film 14 formed on the surface of the spacer 3 or the entire display panel generates heat during its operation, a temperature of the spacer 3 increases. If a temperature coefficient of resistance of the high resistance film 14 is a large negative value, the resistance value decreases as the temperature increases. Therefore, the current flowing into the high resistance film 14 increases, thereby causing a further increase in temperature. Then, the current increases until it exceeds the limitation of a power source. It is found from experiences that a value of the temperature coefficient of resistance in which such a current runaway is caused is a negative value and its absolute value is equal to or larger than 1%. That is, it is preferable that the temperature coefficient of resistance of the high resistance film 14 is a value larger than −1%.

As a construction material of the high resistance film 14, for example, a metallic oxide can be used. The metallic oxide is preferably a chromium oxide, a nickel oxide, or a copper oxide. This is because those oxides have a relatively small secondary emission efficiency and are resistant to charge even if electrons emitted from the electron-emitting devices 8 impinge on the spacer 3. In addition to those metallic oxides, carbon is a preferable material because its secondary emission efficiency is small. In particular, amorphous carbon is easy to obtain a suitable surface resistance of the spacer 3 because it has a high resistance. In addition, a ceramic in which a metal, a metallic oxide, or the like is dispersed can be applied.

As another construction material of the high resistance film 14, a nitride of an alloy of aluminum and transition metal is a suitable material. This is because a resistance value can be controlled within a wide range from a good conductor to an insulator by adjusting a composition of the transition metal and a change in resistance value during a display panel manufacturing process is small to stabilize the resistance value. As the transition metal element, Ti, Cr, Ta, or the like can be used.

A film made of the alloy nitride can be formed by a thin film forming method such as a sputtering method, an electron beam evaporation method, an ion plating method, or an ion assist evaporation method, using a nitrogen gas atmosphere. A film of the metallic oxide can be formed by the thin film forming method using an oxygen gas atmosphere. In addition, the metallic oxide film can be formed by a CVD method or an alkoxide applying method. A film of the carbon is formed by an evaporation method, a sputtering method, a CVD method, or a plasma CVD method. In particular, A film of the amorphous carbon can be obtained using a film formation atmosphere containing hydrogen or using a hydrocarbon gas as a film formation gas.

As describe above, the spacer 3 is sandwiched between the rear plate 1 and the face plate 2 and the high resistance film 14 covering the surface of the spacer 3 is pressed to the wiring on the rear plate 1 side (row directional wiring 5 in this embodiment) and the electroconductive member on the face plate 2 side (metal back 11 in this embodiment) and electrically connected with them. In particular, as shown in FIG. 2, intersection portions of the row directional wiring 5 which intersect the column directional wirings 6 protrude to the face plate 2 side by the thickness of the column directional wirings 6 as compared with other portions. Therefore, the electrical connection between the high resistance film 14 and the row directional wiring 5 is made by the contact between each of the intersection portions and the high resistance film 14. That is, as shown in FIG. 3, the intersection portions of the row directional wiring 5 which intersect the column directional wirings 6 become contact portions 15 and other portions become non-contact portions 16. Therefore, the electrical connection between the high resistance film 14 and the row directional wiring 5 is made at intervals of the intersection portions. An equipotential line 17 near the rear plate 1 on the surface of the spacer 3 in this time is schematically shown by a wide line in FIG. 2.

As is apparent from the equipotential line 17 shown in FIG. 2 and from FIG. 3, the high resistance film 14 also exists in the non-contact portions 16, so that a potential near the non-contact portions 16 rises. This is because, with respect to resistance values on paths of current flowing from the metal back 11 to the contact portions 15, a resistance value on a path of current flowing through the non-contact portion 16 is larger than a resistance value on a path of current flowing without involving the non-contact portion 16 (for example, a path of current flowing from a region just above the contact portion 15). Therefore, the potential rises by voltage drop caused according to the increased resistance value.

As shown in FIGS. 1 and 2, the column directional wirings 6 are disposed at the same intervals. Therefore, the contact portions 15 and the non-contact portions 16 are formed at the same intervals. In addition, as is apparent from FIG. 1, the electron-emitting devices 8 is located between the row directional wirings 5 and the column directional wirings 6. Thus, all the electron-emitting devices 8 adjacent to the spacer 3 are located adjacent to the non-contact portions 16 and all electron beams emitted from the electron-emitting devices 8 are uniformly affected by the surface potential of the spacer corresponding to the non-contact portions 16.

As schematically shown in FIG. 4, each of the electron-emitting devices 8 other than ones adjacent to the spacer 3 in this embodiment is provided at a substantial center between the adjacent rows directional wirings 5. The electron-emitting devices 8 adjacent to the spacer 3 are provided at positions closer to the spacer 3 than the substantial center by a distance L. The distance L is called an offset. As in an electron beam trajectory 18 indicated by a broken line in FIG. 4, an electron emitted from the electron-emitting device 8 is (1) flown so as to move away from the spacer 3 in the vicinity of the election-emitting region of the electron-emitting device 8 and (2) flown so as to approach the spacer 3 in a position corresponding to the vicinity of the bottom of the spacer 3. Finally, the election reaches a preferable impinging position 19. Here, the preferable impinging position indicates each position where an interval between adjacent impinging positions of electron beams emitted from the plurality of electron-emitting devices 8 which are arranged becomes substantially the same interval. According to the mode shown in FIG. 4, the preferable impinging position is identical to the face plate portion opposed to the position corresponding to the substantial center between the adjacent row directional wirings.

Hereinafter, the reason why the election beam reaches the preferable impinging position 19 will be described in detail.

Vicinity of Electron-Emitting Region

As compared with a voltage for election beam acceleration, which is applied to the metal back 11, it can be assumed that the row directional wirings 5 and the column directional wirings 6 are substantially on the same potential (0 V). The contact portion 15 between the high resistance film 14 and the row directional wiring 5 (see FIG. 3) is located above the electron-emitting device 8 (on the face plate 2 side). Therefore, as shown in FIG. 4, an equipotential line 20 above the electron-emitting device 8 becomes a convex downward curve in the vicinity of the election-emitting region of the electron-emitting device 8. When the electron-emitting device 8 is located not at a position biased to the spacer 3 side but at the substantial center between the adjacent row directional wirings 5, the electron beam takes a substantially perpendicular trajectory based on the symmetry of a potential distribution. When the electron-emitting device 8 is located close to the spacer 3 as in this embodiment, the potential distribution becomes asymmetrical. Therefore, the election beam takes a trajectory that it moves away from the spacer 3.

FIG. 5 shows an electron beam trajectory 18 in the case where the electron-emitting device 8 adjacent to the spacer 3 is located at the substantial center between the adjacent row directional wirings 5 without providing the offset L. FIG. 6 shows an electron beam trajectory 18 in the case where the electron-emitting device 8 is located close to one of the adjacent row directional wirings 5 by the offset L (distance from the center between the adjacent row directional wirings 5 to the electron-emitting region of the electron-emitting device 8) in a state in which the spacer 3 is removed.

An element for which the electron beam moves away from the spacer 3 is a function of the offset L. In this embodiment, the electron beam trajectory 18 is moved away from the spacer 3 as the offset L increases (the electron-emitting device 8 approaches the spacer 3). FIG. 7 shows a relationship between the offset L and a distance from the spacer 3 to a position on which the electron beam impinges.

Corresponding Position near Bottom of Spacer 3

As described with reference to FIGS. 2 and 3, the high resistance film 14 of the spacer 3 is in contact with the row directional wiring 5 at each of the intersection portions with the column directional wirings 6. As a result, the potential on the non-contact portion 16 shown in FIG. 13 rises. Thus, as shown in FIG. 4, the convex equipotential line 20 is produced above a corresponding position near the bottom of the spacer 3, so that the electron beam is flown so as to approach the spacer 3.

An element for which the electron beam approaches the spacer 3 is a function of an area (contact area) S of the contact portion 15 (see FIG. 3), which is determined according to a contact state between the high resistance film 14 and the row directional wiring 5. FIG. 8 shows this function. As shown in FIG. 8, the electron beam moves away from the spacer 3 as the contact area S increases.

The contact state between the high resistance film 14 and the row directional wiring 5 can be represented by not only the area S but also various other parameters. For example, the contact state can be represented by a function of, a girth of the contact portion 15 shown in FIG. 3, a length Gy of the non-contact portion 16 in the width direction of the row directional wiring 5, a distance Gx between the adjacent contact portions 15 in the longitudinal direction of the row directional wiring 5 or the like. As the girth of the contact portion 15 becomes shorter or as Gx or Gy becomes longer, the electron beam approaches the spacer 3.

As is apparent from the above description, the impinging position of the electron beam can be controlled according to a separate independent parameter which is not related to the spacer 3, such as the offset L or the contact state between the high resistance film 14 and the row directional wiring 5 (for example, contact area S).

FIG. 9 is a curve graph showing a relationship between the offset L and the area S of the contact portion in the case where the electron beam impinges on the preferable impinging position 19 (see FIG. 4), in which the ordinate indicates the offset L and the abscissa indicates the contact area S.

As is apparent from FIG. 9, there are a plurality of conditions that the electron beam impinges on the preferable impinging position 19 without displacement. For example, it can be designed using a condition of a point A or a condition of a point B in FIG. 9. When it is designed using the condition of the point B in which the offset L is large and the contact area S is small as compared with the condition of the point A, for example, the cross section of the row directional wiring 5 is set to a vault shape and the upper surface of the row directional wiring 5 is set to not a flat surface but a curved surface. Therefore, the contact area S can be reduced.

In an actual design, the offset L and the contact state (for example, contact area S) in the case where the electron beam impinges on the preferable impinging position 19 is determined from, for example, electrostatic field calculation and electron beam trajectory simulation. In addition, it is possible to determine a condition based on measured data.

As described above, according to this embodiment, the contact state between the high resistance film 14 and the row directional wiring 5 and the offset L are controlled without depending on the structure of the spacer 3, so that a desirable electron beam impinging position can be achieved. Therefore, according to this embodiment, the spacer 3 having the same structure can be applied to various image forming apparatuses. For example, even when the specification is changed by changing a pixel pitch to obtain high definition or increasing an accelerating voltage to obtain a high intensity, the contact state between the high resistance film 14 and the row directional wiring 5 and the offset L are changed, so that the same spacer 3 can be applied. Therefore, according to the present invention, the productivity can be greatly improved to significantly reduce a manufacturing cost.

The display panel according to the present embodiment may comprise PD200 provided by ASAHI GLASS CO., LTD. as the base 13 of the spacer 3, and, as the high resistance film 14, a film of a nitride of tungsten-germanium alloy (WGeN) formed by subjecting, to a sputtering, simultaneously both of a tungsten target and a germanium target within a nitrogen gas. The film is formed while rotating the base 13 of the spacer 3, to have a thickness 200Åover the surface thereof and to have a sheet resistance $2.5\times10^{12}$ Ω/□.

Table 1 shows the relationship between the area S and the offset L in the display panel described in this embodiment. Here, assume that a total thickness of the spacer 3 is 300 μm, a total height of the spacer 2.4 mm, an interval between the adjacent column directional wirings 6 (an interval between contact portions) is 300 μm, an interval between the adjacent row directional wirings 5 is 920 μm, a width of the row directional wiring 5 is 690 μm, a height from the electron-emitting region of the electron-emitting device 8 to the upper surface of the row directional wiring 5 is 75 μm, an applied voltage to the metal back 11 is 15 kV, and an applied voltage to the row directional wirings 5 and the column directional wirings 6 is 14 V. Note that conditions A and B in Table 1 correspond to the points A and B in FIG. 9, respectively.

TABLE 1

| Condition | L (μm) | S ($\mu m^2$) |
|---|---|---|
| A | 17.6 | 30625 |
| B | 29.5 | 22500 |

Second Embodiment

Only a point of a second embodiment of the present invention, which is different from the first embodiment, will be described.

Figure 10:
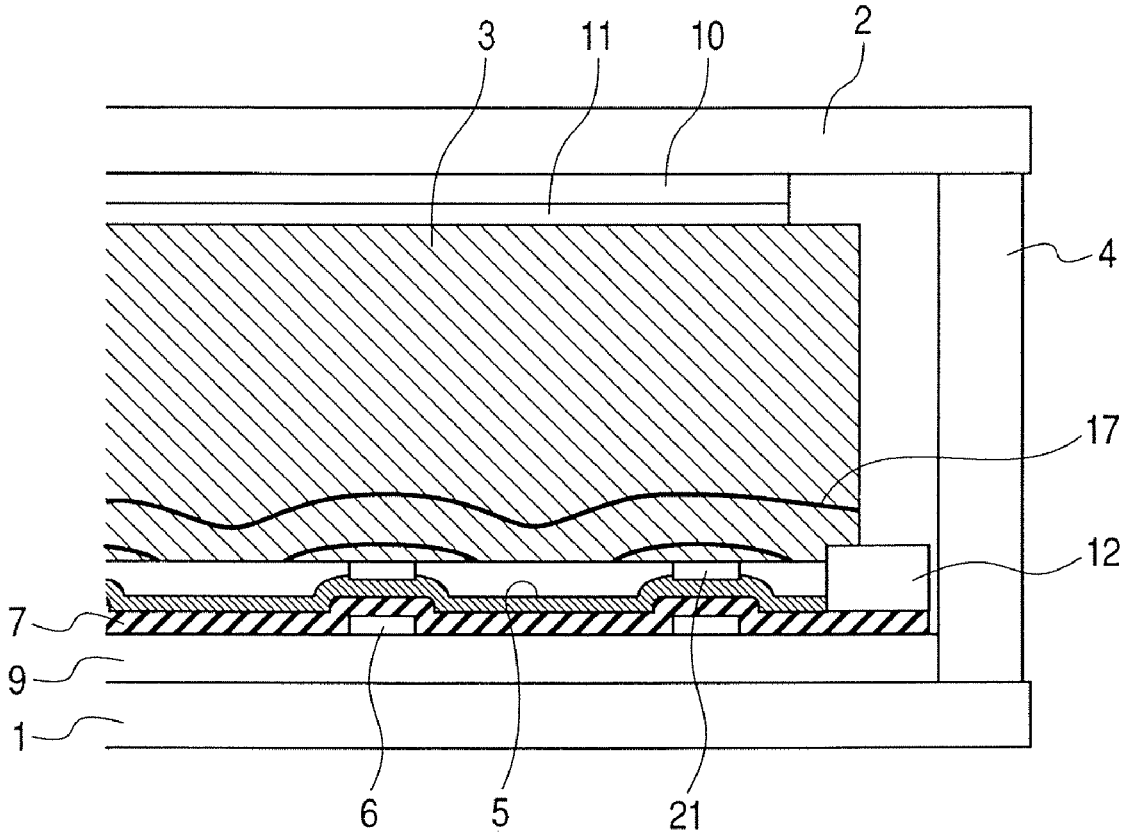
FIG. 10 is a partial sectional view showing an image forming apparatus in a longitudinal direction of a spacer, according to a second embodiment of the present invention.
Figure 11:
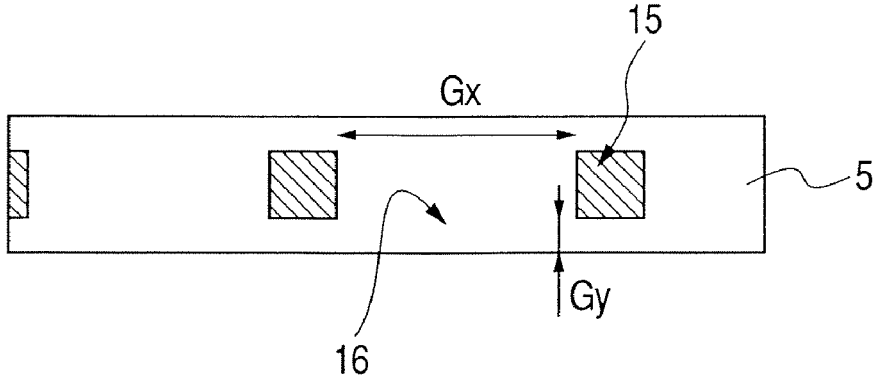
FIG. 11 is an explanatory view showing a contact portion and a non-contact portion between a high resistance film of a spacer and a row directional wiring according to the second embodiment of the present invention.
Figure 12:
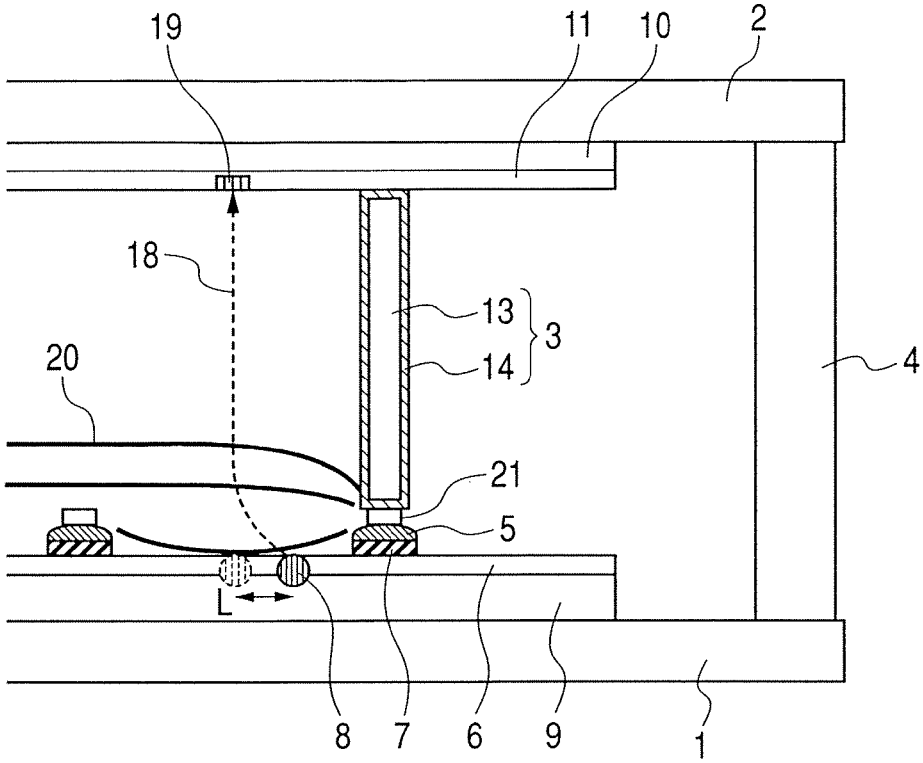
FIG. 12 is a partial sectional view showing the image forming apparatus in a direction orthogonal to the spacer according to the second embodiment of the present invention.

FIGS. 10, 11, and 12 correspond to FIGS. 2, 3, and 4 in the first embodiment, respectively. A point of this embodiment, which is different from the first embodiment, is that an electroconductive base portion 21 is provided on the row directional wiring 5 at each of the intersection positions with the column directional wirings 6. When such a structure is used, the contact state can be stabilized and the electron beam impinging position can be controlled with high precision.

The electroconductive base portion 21 can be formed on the row directional wiring 5 by the same method as the case of the row directional wiring 5 after the formation of the row directional wiring 5. The electroconductive base portion 21 may be formed on all the row directional wirings 5 or only on the row directional wirings 5 which are in contact with the spacers 3.

The electroconductive base portion 21 is preferably made of a material having hardness greater than that of the base 13 of the spacer 3. For example, there is the case where the spacer 3 is formed using glass as the base 13 and the electroconductive base portion 21 is formed using an electroconductive ceramic having a Young's modulus smaller than that of the glass. In this case, deformation of the electroconductive base portion 21 becomes smaller, variations in shape, position, and the like, of each of the contact portions 15 are reduced. Therefore, a further improvement in the precision of the electron beam impinging position can be expected. Note that the present invention is not limited to the case where the electroconductive base portion 21 is provided. In the case where the wiring and the spacer are in direct contact with each other, when the wiring is allowed to have hardness greater than that of the glass base of the spacer (have a smaller Young's modulus), the same effect is obtained.

Third Embodiment

Only a point of a third embodiment of the present invention, which is different from the second embodiment, will be described.

Figure 13:
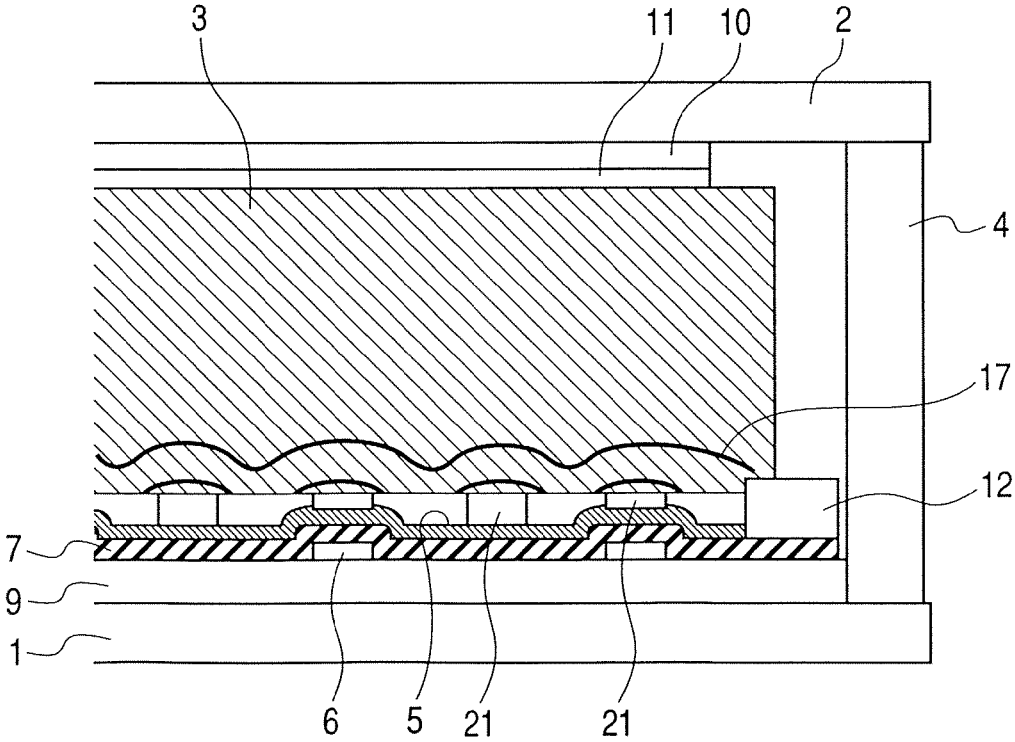
FIG. 13 is a partial sectional view showing an image forming apparatus in a longitudinal direction of a spacer, according to a third embodiment of the present invention.

Unlike the second embodiment, the electroconductive base portions 21 are not necessarily provided on the intersection portions of the row directional wiring 5 which intersect the column directional wirings 6. In this embodiment, as shown in FIG. 13, the electroconductive base portions 21 are disposed at ½ of the pitch in the second embodiment.

As in the second embodiment, each of the electroconductive base portions 21 is preferably made from a member having hardness greater than that of the base 13 of the spacer 3. When the electroconductive base portions 21 are disposed as in this embodiment, there is an advantage that the degree of freedom in contact surface design becomes larger.

The contact between the spacer 3 and the row directional wiring 5 in regions other than the intersection portions of the column directional wirings 6 and the row directional wiring 5 can be made by providing base portions for contact point formation in regions in which the column directional wirings 6 are not formed. An example of the contact will be described below.

Figure 14:
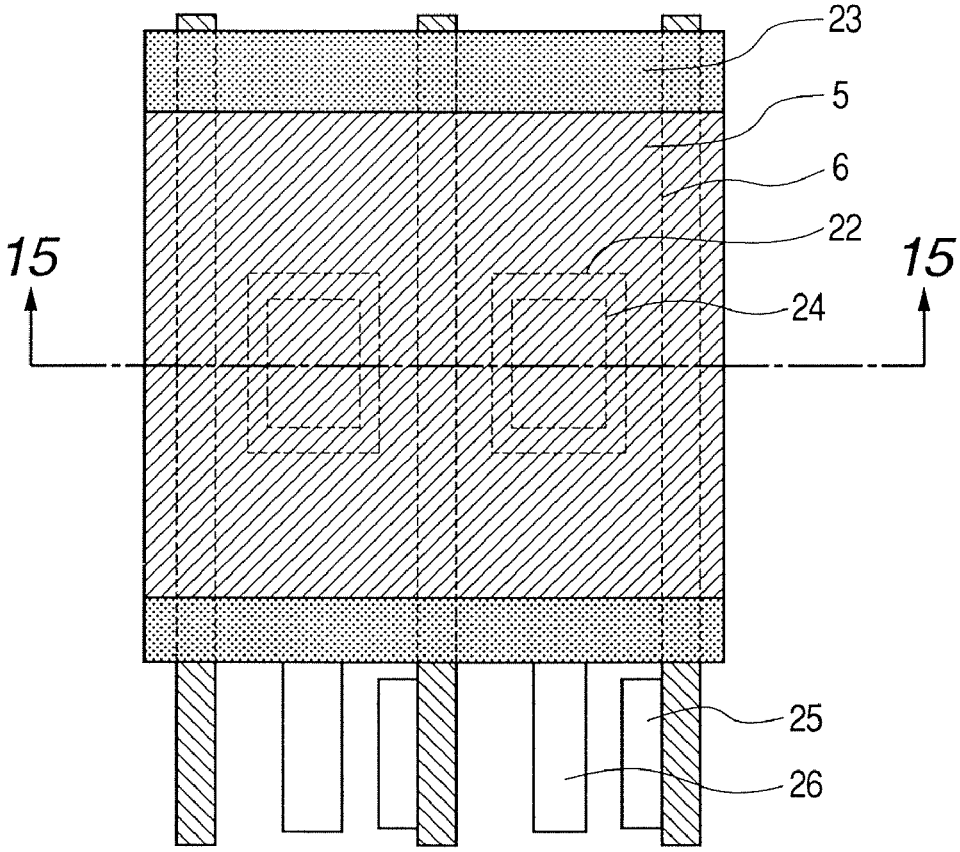
FIG. 14 is a plan view showing a structure in which a base for contact point formation is provided in a region in which a column directional wiring is not formed to thereby form a convex portion in a row directional wiring.
Figure 15:
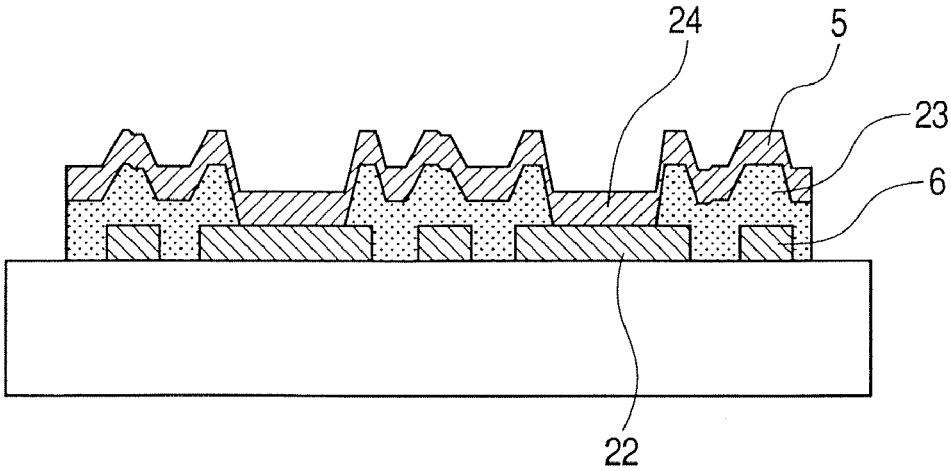
FIG. 15 is a cross sectional view taken along the line 15-15 of FIG. 14.

FIG. 14 is a partially enlarged view showing an outline of such a mode. FIG. 15 is a cross sectional view along a line 15-15 in FIG. 14.

As shown in FIGS. 14 and 15, separate electrodes 22 are provided and connected with the row directional wiring 5 through contact holes 24 provided in an insulating layer 23. In addition, the separate electrodes 22 are connected with a device electrode 25 and a device electrode 26 which are connected with the column directional wirings 6 and oppose to each other. Therefore, the number of contact portions between the spacer 3 (see FIG. 13) and the row directional wiring 5 can be increased using steps caused by the separate electrodes 22 and the contact holes 24 (the number of convex portions of the row directional wiring 5 can be increased).

An example of a specific manufacturing method for such a structure will be described with reference to FIGS. 16A to 16D.

Figure 16A:
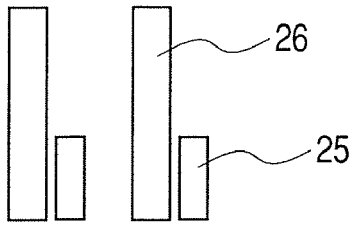
FIGS. 16A, 16B, 16C, and 16D are explanatory views showing forming steps for the structure shown in FIG. 14 and FIG. 15.
Figure 16B:
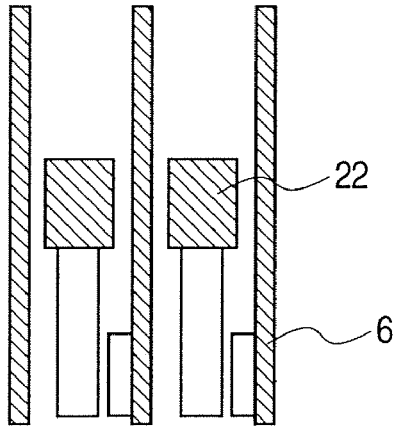
Figure 16C:
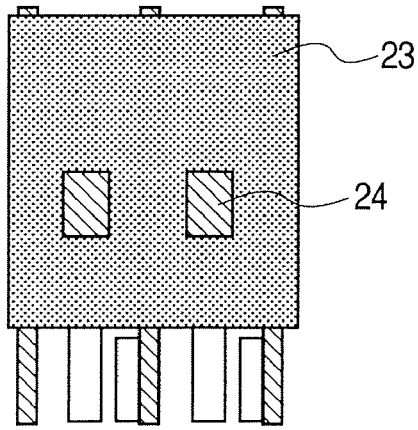
Figure 16D:
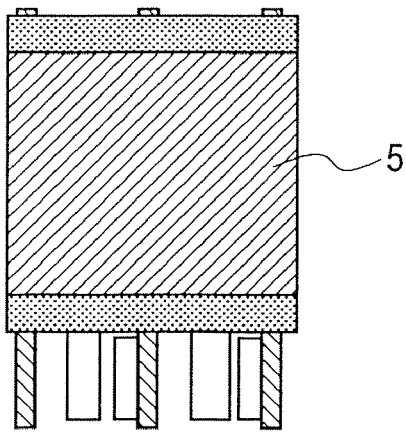

First, as shown in FIG. 16A, the device electrode 25 and the device electrode 26 are formed. Then, as shown in FIG. 16B, the separate electrodes 22 and the column directional wirings 6 are formed at the same time. As shown in FIG. 16C, the insulating layer 23 is partially formed on the separate electrodes 22 and the column directional wirings 6, and then portions of the insulating layer 23 formed on the separate electrodes 22 are removed in a size smaller than that of the separate electrodes 22 to form the contact holes 24. Further, as shown in FIG. 16D, the row directional wiring 5 is formed on the insulating layer 23 and connected with the separate electrodes 22 through the contact holes 24 (see FIG. 16C). The spacer 3 (see FIG. 13) is disposed on the row directional wiring 5 formed thus. Therefore, it is possible to realize a structure in which the contact portions are obtained between the spacer 3 and the row directional wiring 5 in regions except the intersection portions of the column directional wirings 6 and the row directional wiring 5.

Fourth Embodiment

Only a point of a fourth embodiment of the present invention, which is different from the first embodiment, will be described.

Figure 17:
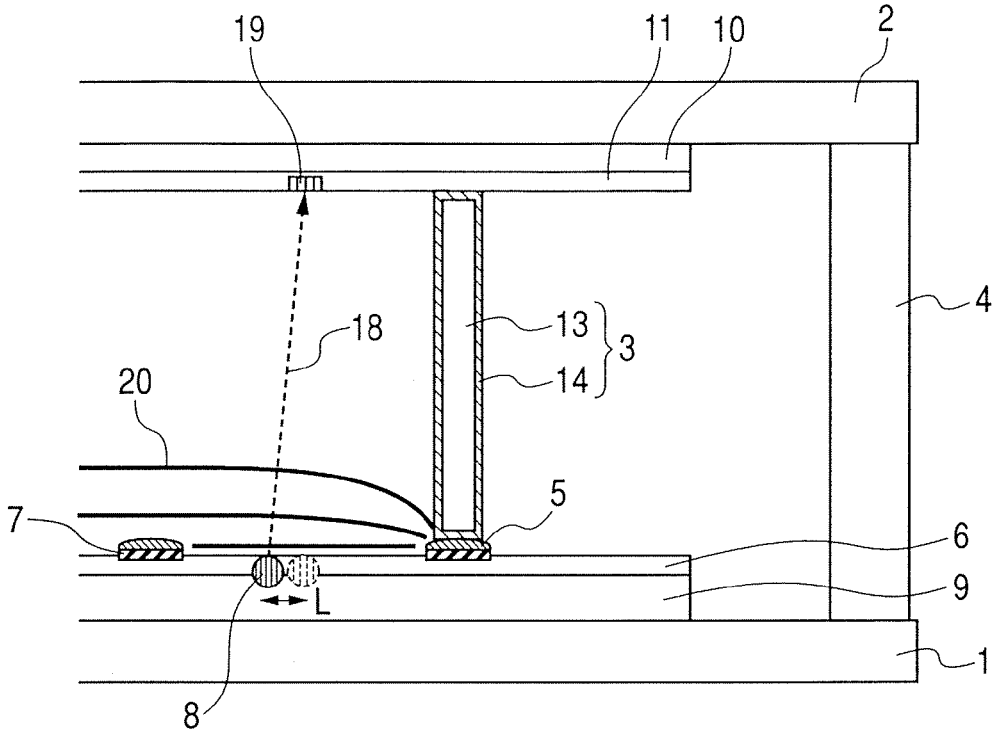
FIG. 17 is a partial sectional view showing an image forming apparatus in a direction orthogonal to a spacer according to a fourth embodiment of the present invention.
Figure 18:
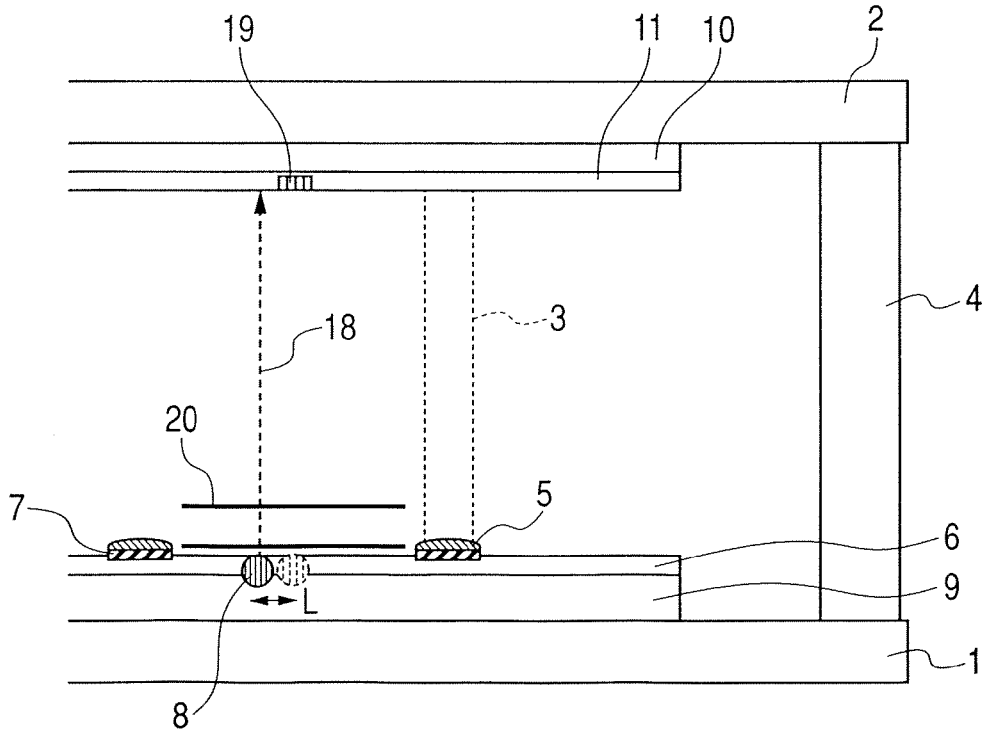
FIG. 18 is an explanatory view showing a trajectory of an electron beam according to the fourth embodiment of the present invention.

FIGS. 17 and 18 correspond to FIGS. 4 and 5 in the first embodiment, respectively. As shown in FIGS. 17 and 18, the contact surface between the spacer 3 and the row directional wiring 5 in this embodiment is located at a lower position and substantially located on the same surface as the electron-emitting region of the electron-emitting device 8. Therefore, as shown in FIG. 17, the equipotential line 20 does not become the convex downward curve as shown in FIG. 4 or becomes a very small change. Therefore, the relationship between the offset L and the electron beam impinging position tends to reverse that in the first embodiment.

In other words, the electron beam approaches the spacer 3 as the electron-emitting device 8 is located close to the spacer 3. Further, when the electron-emitting region of the electron-emitting device 8 is higher than the contact surface between the spacer 3 and the row directional wiring 5, the same tendency is obtained. That is, the electron beam approaches the spacer 3 as the electron-emitting device 8 is located close to the spacer 3.

As shown in FIG. 17, the electron beam emitted from the electron-emitting device 8 located at the position apart from the spacer 3 by the offset L is flown so as to approach the spacer 3 by the distorted equipotential line 20. Therefore, the desirable electron beam impinging position is obtained. The distorted equipotential line 20 is caused by the partial contact between the high resistance film 14 and the row directional wiring 5 as described in the first embodiment. FIG. 18 shows an electron beam trajectory 18 in the case where the electron-emitting device 8 is located close to one of the adjacent row directional wirings 5 by the offset L in a state in which the spacer 3 is removed.

As described above, when the present invention is also applied to the case where a design change of a display panel is large, an image forming apparatus in which no displacement of the electron beam is caused can be realized.

Fifth Embodiment

Only a point of a fifth embodiment of the present invention, which is different from the first embodiment, will be described.

This embodiment is an example in which the contact control of the spacer 3 is applied to the face plate 2 side.

Figure 19:
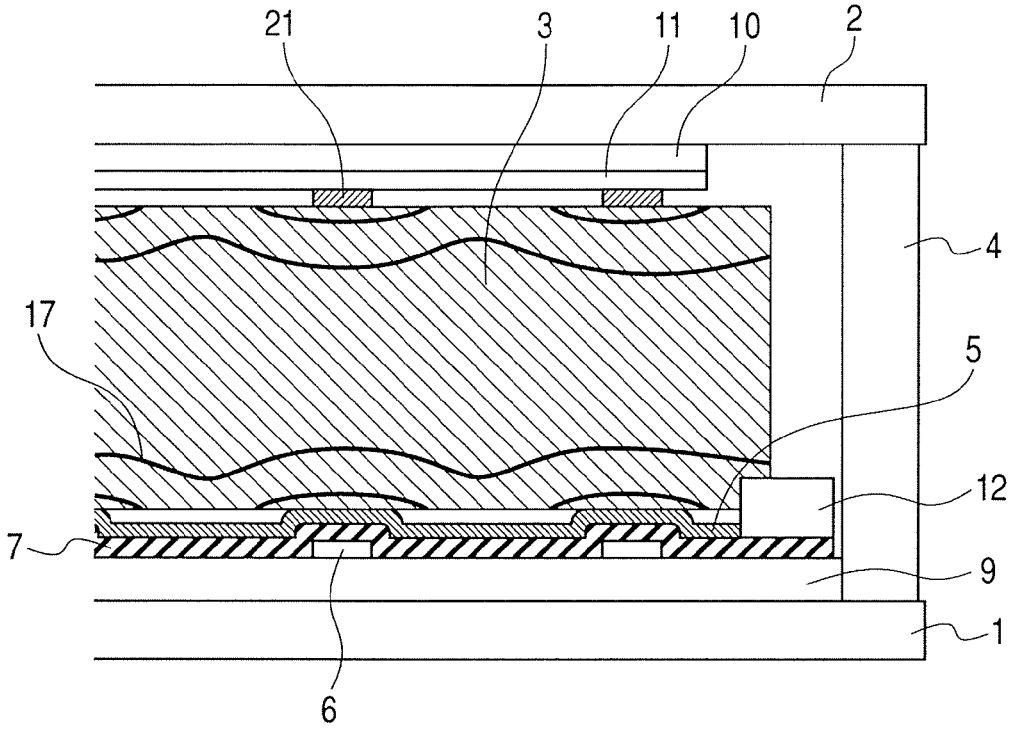
FIG. 19 is a partial sectional view showing an image forming apparatus in a longitudinal direction of a spacer, according to a fifth embodiment of the present invention.
Figure 20:
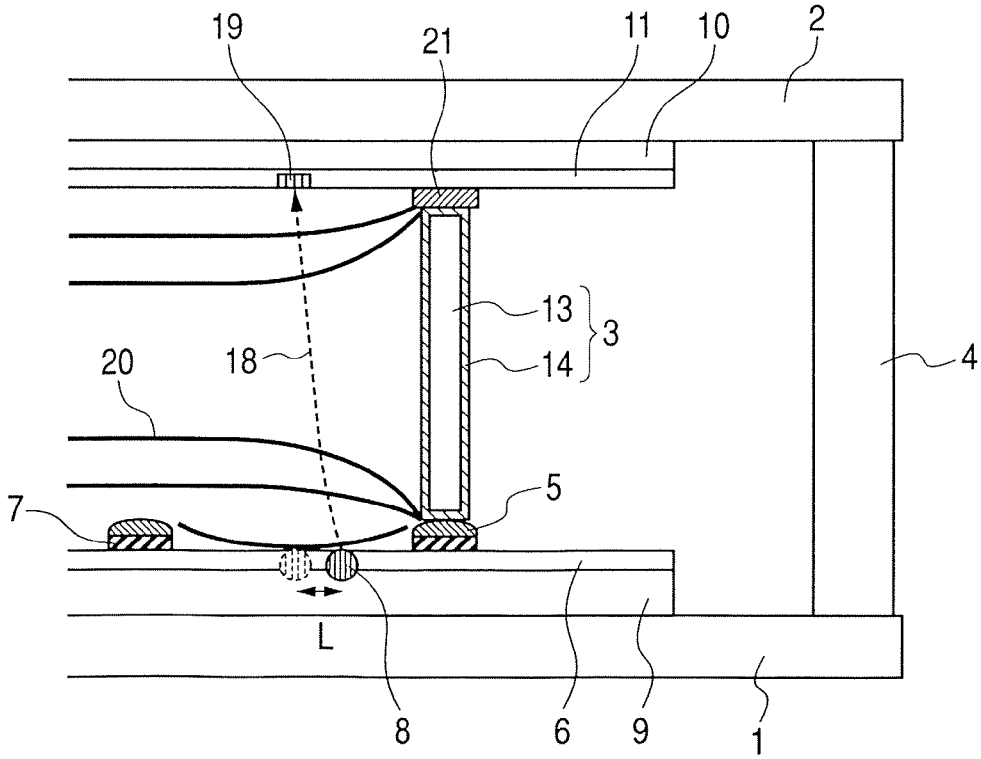
FIG. 20 is a partial sectional view showing the image forming apparatus in a direction orthogonal to the spacer according to the fifth embodiment of the present invention.
Figure 21A:
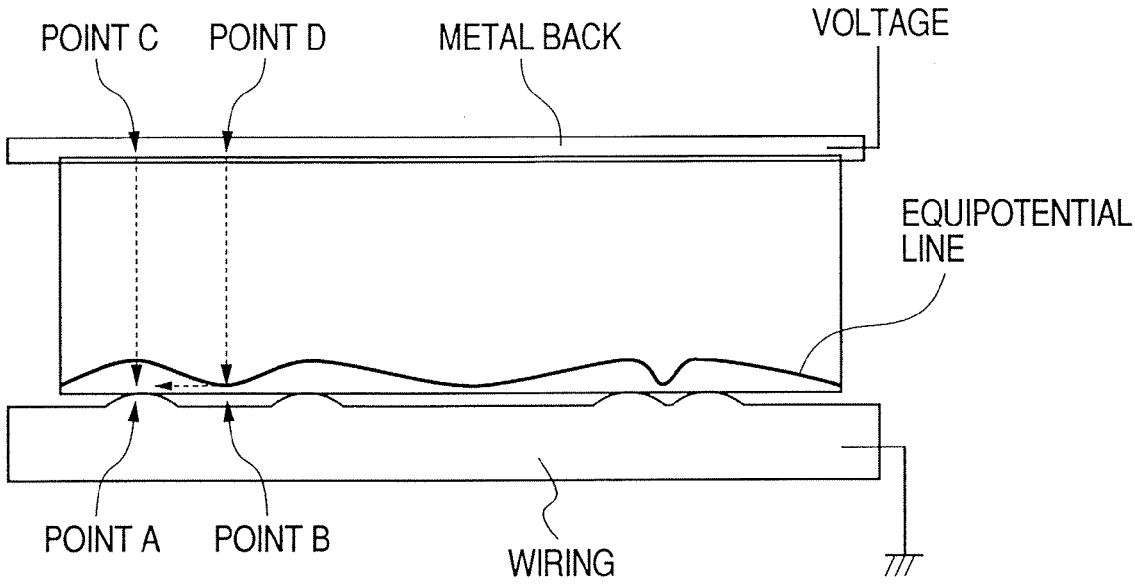
FIGS. 21A and 21B are explanatory views showing a spacer in the case where it is in contact with a wiring at an irregular contact portion.
Figure 21B:
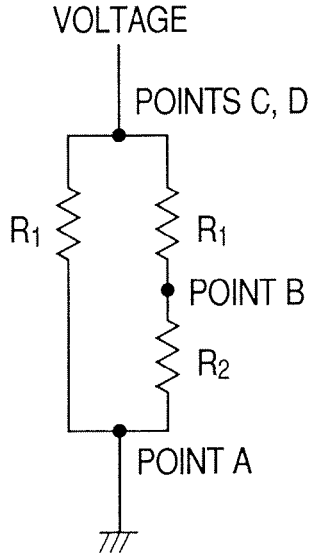

FIGS. 19 and 20 correspond to FIGS. 2 and 4 in the first embodiment, respectively. In this embodiment, the electroconductive base portions 21 are provided on the face plate 2 side. Therefore, the contact portions 15 and the non-contact portions 16, which are described with reference to FIG. 3, are formed on the face plate 2 side to control a potential distribution, thereby achieving the desirable election beam impinging position.

More specifically, as shown in FIG. 20, (1) the electron beam is moved away from the spacer 3 in the vicinity of the election-emitting region of the electron-emitting device 8, (2) allowed to approach the spacer 3 at a height position in the vicinity of the contact surface of the spacer 3 with the row directional wiring 5, and (3) again moved away from the spacer 3 in the vicinity of the contact surface of the spacer 3 with the metal back 11. Thus, a desirable election beam trajectory 18 is obtained.

In this embodiment, the structure using the electroconductive base portions 21 is employed. A structure using, for example, the above-mentioned black conductor (black strip) as an electroconductive member, which is in contact with the face plate 2 side, may be employed. The ideas of the contact controls on the rear plate 1 side, which are described in the first embodiment to the third embodiment, can be applied to the contact control on the face plate 2 side.

More specifically, an element that moves the electron beam trajectory 18 away from the spacer 3 in the vicinity of the contact surface of the spacer 3 on the face plate 2 side is a function of a contact state between the high resistance film 14 and the electroconductive base portion 21 on the face plate 2 side, for example, a function of the contact area S. the electron beam moves away from the spacer 3 as the contact area S decreases. In addition, the electroconductive base portion 21 having hardness greater than that of the base 13 of the spacer 3 is an advantage for the high precision control of the election beam position. Further, the electroconductive base portion 21 can be designed and disposed at an arbitrary position.

In this embodiment, the high resistance film 14 of the spacer 3 is allowed to be in contact with the row directional wiring 5 on the rear plate 1 side. When the surface of the column directional wiring 6 is exposed, it is possible to allow the high resistance film 14 to be in contact with the column directional wiring 6.

As described above, according to the present invention, the contact state between the spacer and the wiring on the rear plate side or the electrode on the face plate side is controlled. Therefore, the desirable election beam impinging position can be obtained. More specifically, the non-contact portion is positively formed on the contact between the spacer and the wiring or the electrode by the shape control of the contact portion, thereby positively controlling a change in potential on the non-contact portion. Thus, it is possible to obtain the electric field distribution near the spacer, which is suitable to the desirable election beam impinging position.

The position of the electron-emitting device is shifted according to a distance between the desirable election beam impinging position and the spacer, thereby obtaining the desirable election beam impinging position. With respect to such a structure, there are, for example, a structure in which the wiring on the rear plate is formed in the positively concave and convex shape which is equal to or larger than a variation (surface roughness, partial protrusion, or the like) depending on a manufacturing method, thereby positively controlling the contact portion, and a structure in which an electroconductive member is sandwiched between the spacer and the wiring at a predetermined position, thereby positively controlling the contact portion. In other words, the present invention is based on a change in thinking, in which the entire contact between the spacer and the wiring is not made but the partial contact therebetween is positively made to form the controlled equipotential surface on the surface of the spacer.

Also, according to the present invention, the contact state between the high resistance film of the spacer and the wiring on the rear plate side or the electrode on the face plate side and preferably the offset of the electron-emitting device are controlled without depending on the structure of the spacer 3. Therefore, the desirable electron beam impinging position can be achieved. More specifically, at least one of (1) the contact state of the spacer on the rear plate side and (2) the contact state of the spacer on the face plate side and preferably (3) the offset of the electron-emitting device are controlled. Therefore, the desirable electron beam impinging position can be achieved. Furthermore specifically, (1) the potential distribution of the non-contact portion of the spacer on the rear plate side is controlled, (2) the potential distribution of the non-contact portion of the spacer on the face plate side is controlled, and (3) the electron beam trajectory immediately after electron emission is controlled using the asymmetrical electric field produced from a difference of height between the contact position of the spacer on the rear plate side and the position of the electron-emitting region and the offset of the electron-emitting device. Therefore, the desirable electron beam trajectory can be obtained.

Those parameters are relatively easily designed from, for example, the calculation of the electrostatic field determined by the shape of the panel and the easy simulation of the electron beam.

Further, even when the electron beam trajectory is deviated near the spacer by some cause, the desirable electron beam impinging position can be achieved without providing the spacer itself with a function for compensating the deviation in electron beam trajectory.

Therefore, when three separate parameters, which are not related to the spacer itself, are controlled, it is possible to design the electron beam trajectory. Thus, according to the present invention, there is a merit that the degree of freedom in design becomes larger.

The shape control can be performed using a member specific to the panel as an object which is allowed to be in contact with the high resistance film of the spacer. More specifically, the member is the intersection portion of the row directional wiring and the column directional wiring on the rear plate or the black conductor on the face plate. This case is advantageous in cost. In order to control the contact position, the electroconductive base portion can be disposed above the rear plate or the face plate. In this case, unless the electroconductive base portion inhibits the electron beam trajectory, the base portion can be disposed at an arbitrary position. Therefore, there is a merit that the degree of freedom in design becomes much larger.

According to the present invention, the spacer having the same structure can be applied to various modes of display apparatuses. Therefore, even when the specification of the mode of the display apparatus is changed by changing the pixel pitch to obtain the high definition or by increasing the accelerating voltage to obtain the high intensity, only a slight change in design of the object which is allowed to be in contact with the spacer is performed, so that it is unnecessary to change the design of the spacer. In addition, the same spacer member can be applied to a plurality of products. Thus, the productivity can be greatly improved to significantly reduce a manufacturing cost.

What is claimed is:

1. An image forming apparatus comprising:

a first substrate having a plurality of electron emitting devices and a wiring for driving the electron-emitting devices;

a second substrate disposed in opposition to the first substrate, and having an electroconductive member set at a potential higher than that of the wiring; and a plate shaped spacer disposed along the wiring between the first and second substrates, the spacer being covered with a film of a resistance higher than that of the wiring, wherein the wiring has a plurality of protrusions arranged along a longitudinal direction of the wiring, the film and the wiring directly contact mutually at the plurality of protrusions, and the contact portions are separated mutually by a gap.

2. An image forming apparatus comprising:

a first substrate having a plurality of electron emitting devices and a wiring for driving the electron-emitting devices;

a second substrate disposed in opposition to the first substrate, and having an electroconductive member set at a potential higher than that of the wiring;

a plate shaped spacer disposed along the wiring between the first and second substrates, the spacer being covered with a film of a resistance higher than that of the wiring; and on the wiring, a plurality of electroconductive protrusions arranged along a longitudinal direction of the wiring, wherein the film contacts directly the plurality of electroconductive protrusions, and the contact portions are separated mutually by a gap.

* * * * *